US006129471A

United States Patent [19]

Lang

[11] Patent Number: 6,129,471

[45] Date of Patent: Oct. 10, 2000

[54] STICK APPLICATOR WITH INCREMENTAL DISPENSING ACTION

[75] Inventor: Frank J. Lang, Warrenville, Ill.

[73] Assignee: Federal Package Networks, Inc., Chaska, Minn.

[21] Appl. No.: 09/204,081

[22] Filed: Dec. 3, 1998

[51] Int. Cl.[7] ..... B43K 21/08

[52] U.S. Cl. ..... 401/75; 401/194; 401/68

[58] Field of Search ..... 401/75, 194, 76, 401/77, 78, 68

[56] References Cited

U.S. PATENT DOCUMENTS

| | | | |
|---|---|---|---|
| D. 335,443 | 5/1993 | Hirst . | |
| D. 385,779 | 11/1997 | Sokol et al. . | |
| 1,309,900 | 7/1919 | MacCorkell . | |
| 1,950,324 | 3/1934 | Powers . | |
| 2,284,218 | 5/1942 | Livingston . | |
| 3,159,163 | 12/1964 | Curti . | |
| 3,653,776 | 4/1972 | Geisel . | |
| 3,917,417 | 11/1975 | Lang . | |
| 4,139,127 | 2/1979 | Gentile . | |
| 5,727,891 | 3/1998 | Lang . | |
| 5,851,079 | 12/1998 | Horstman et al. | 401/194 X |

FOREIGN PATENT DOCUMENTS

| | | | |
|---|---|---|---|
| 3118893 | 11/1982 | Germany | 401/194 |

*Primary Examiner*—David J. Walczak
*Attorney, Agent, or Firm*—Breiner & Breiner

[57] ABSTRACT

A screw operated stick applicator providing for controlled dispensing of a product in predetermined increments based on a click action mechanism. A tubular body holds a supply of product, which is dispensed by the action of a dispensing screw having a control member adjacent the base wall of the tubular body and a threaded shaft inside the body. The shaft is threadably engaged to a movable product support. Protrusions on the dispensing screw interact with the base wall of the body to provide resistance to the smooth rotation of the control member and cause the control member to favor certain predetermined positions. The base wall includes an inner wall surface at its lower end which interacts with the protrusions to provide click action and, thus, controlled incremental dispensing.

6 Claims, 1 Drawing Sheet

STICK APPLICATOR WITH INCREMENTAL DISPENSING ACTION

FIELD OF INVENTION

The present invention relates to a stick applicator for dispensing a highly viscous product, such as a substantially solid or solid, product.

More particularly, the present invention relates to a screw operated stick applicator capable of readily dispensing predetermined incremental amounts of product.

BACKGROUND OF THE INVENTION

Various screw operated applicators are known in the art as described for example in U.S. Pat. No. 3,917,417. They are useful for dispensing such products as lip balms, deodorants, lubricants and the like.

In a typical stick applicator, the product to be dispensed sits within a tubular body of cylindrical or other shape. The product is supported in the body by a follower-plate or elevator which travels inside the body along the body's length. This follower plate or elevator is threadably engaged with a shaft of a dispensing screw having a handgrip member abutting the tubular body. The threaded shaft runs inside the body along the body's length. The follower plate or elevator moves in response to turning of the handgrip member.

In operation of the above described applicator, a user turns the handgrip member causing the threaded shaft of the screw to turn, and thereby cause the follower plate or elevator to travel inside the tubular body with concomitant movement of the product up or down from the dispensing opening in the body. The amount of product dispensed from or retracted into the body is proportionate to the extent to which the handgrip member is turned.

Deficiencies in existing stick applicators make them less than optimal in use. First, the amount of product dispensed is difficult to control because it is indiscriminately dispensed when the handgrip member is turned. Special care and attention are required to position the handgrip member so that a precise desired amount of product is exposed or dispensed. If too much of the product is extended, the stick can break. If too little is extended, inadequate application of the product results or repeated application is required. Second, accidental dispensing can be a problem with existing stick applicators. Since there is no stop or check on the handgrip member, it is easily turned by various types of unintended contact.

While other stick applicator structures are known which provide for incremental disposing, such structures are complex requiring multiple components of interrelating structures. This is expensive in terms of materials, time, and labor in assembly during the manufacturing process. For example, U.S. Pat. No. 1,950,324 describes a lipstick holder structured for clicking in incremental fashion for dispensing lipstick from the holder. FIGS. 1–3 of the patent illustrate a first embodiment using a plate with projections in conjunction with recesses formed in a base which in turn operate in conjunction with a turning means. In a second embodiment of FIGS. 4 and 5, corrugations and a pin structure are utilized rather than projections and recesses. This type of structure requires multiple interacting components. Cost in terms of materials, manufacturing time and assembly is a major consideration.

It would be advantageous to have a screw operated stick applicator that avoids accidental dispensing of product and that allows a user to quickly and easily dispense convenient predetermined amounts of product incrementally and without resorting to careful fine tuning of the handgrip member, in particular which does not require complex and expensive dispensing structures.

BRIEF DESCRIPTION OF THE INVENTION

A primary object of the present invention is to provide a screw operated stick applicator that regulates the amount of product dispensed to equal predetermined increments.

A further primary object of the present invention is to provide a stick applicator that avoids accidental dispensing of product.

A further primary object is to provide such a stick dispenser which is simple in structure and does not require costly additional parts or manufacturing and assembly steps as compared to conventional stick applicator structures providing for incremental dispensing.

Accordingly, an improved stick applicator is provided having a modified dispensing screw and a modified tubular body that achieves these objects. Thus, the screw operated applicator of the present invention has a click-action feature whereby the dispensing screw interacts with the tubular body providing predetermined dispensing increments to thereby regulate the amount of product dispensed during use.

In the stick applicator of the invention, the product is stored within a tubular body. The product is supported in the body by a propelling support, such as a follower plate or elevator, which can travel inside the body along the body's length but is prevented from rotating about the body's axis. The support is threaded and received on a threaded shaft of a dispensing screw. The shaft of the dispensing screw is present inside the tubular body. Connected to the shaft is a control member which is positioned adjacent and partially in the base of the tubular body.

Turning of the control member of the dispensing screw turns the threaded shaft which in turn causes the support to move up or down inside the tubular body with concomitant extension or retraction of product from the open dispensing end of the body.

The screw operated applicator of the invention is configured so that the control member favors certain predetermined positions as it is turned by a user. More specifically, the dispensing screw has at least one protrusion on or near the control member that interacts with a specially configured wall structure present in the tubular body to interfere with or resist continuous or uncontrolled turning of the control member. The effect is that the control member stops at certain predetermined orientations upon turning and further turning by a user is required for continued turning and thus dispensing.

DETAILED DESCRIPTION OF THE PRESENTLY PREFERRED EMBODIMENTS

Having described the invention in general terms, a description of presently preferred embodiments is set forth with reference to the drawings.

Figure 1:
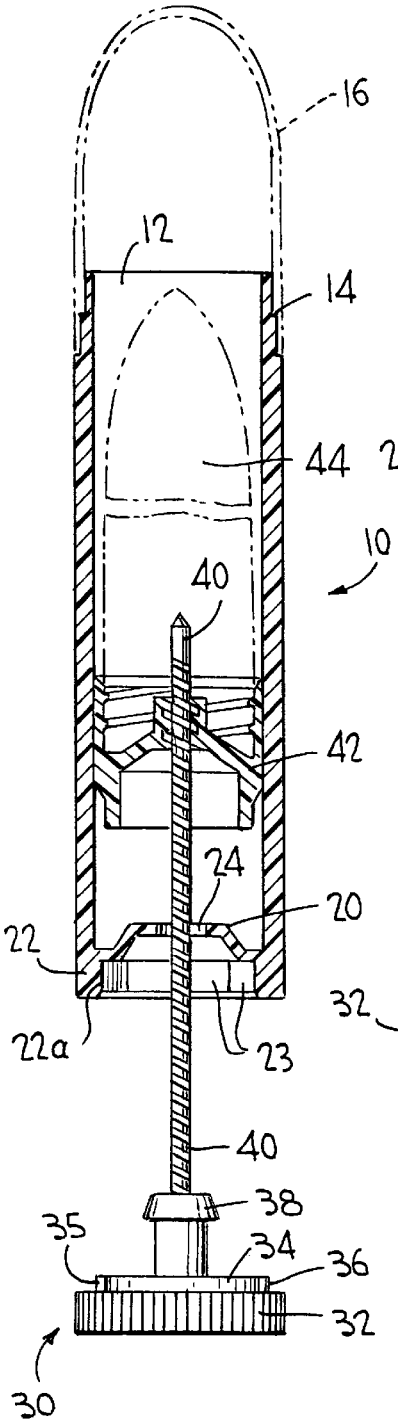
FIG. 1 is an exploded cross-sectional view of a stick applicator according to the invention.

Referring to FIG. 1, an exploded cross-sectional view of a screw operated stick applicator is shown. Tubular body 10 is shown in the preferred form of a cylinder. For convenience of discussion, the stick applicator will be described in terms of a lip balm stick applicator. Necessarily variations in size and shape are possible depending on the use of the product contained in the applicator. For example, conventional lip balm applicators have a body size of approximately ⅝" in diameter and 2" in length. The tubular body, as well as the other parts of the applicator, are preferably manufactured from plastic as conventionally known in the art. While the raised portion 34 may only contain one protrusion, two protrusions are preferred as described below. Body 10 has an open dispensing end 12 which on its exterior includes a stepped surface 14 for receiving a removable cap 16. Body 10 also has a base wall 20 with a lower end 22 and a central hole 24 for receiving a dispensing screw 30. Lower end 22 has inner wall surface 23 which is further described below.

Figure 2:
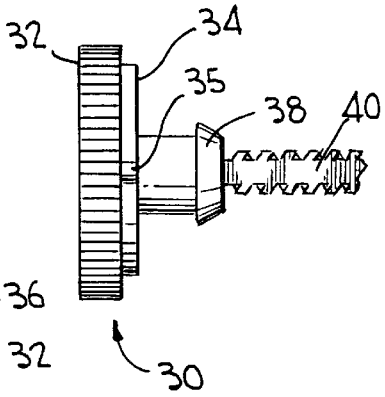
FIG. 2 is a partial view of a dispensing screw according to the invention.
Figure 3:
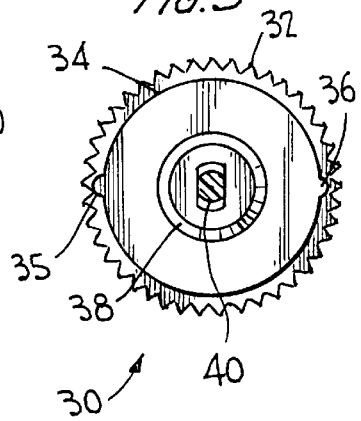
FIG. 3 is a top plan view of the dispensing screw of FIG. 2.

Dispensing screw 30 includes a hand operated control member 32 and threaded shaft 40. Control member 32 includes an inwardly extending raised portion 34 of lesser diameter than control member 32. Raised portion 34 inserts into lower end 22 of body 10. Portion 34 as shown includes opposing protrusions 35 and 36, two protrusions being preferred. Dispensing screw 30 also includes a securing snap shoulder 38. Referring to FIGS. 2 and 3, the features of screw 30 are shown in greater detail in side and top views, respectively.

Referring to FIG. 1, dispensing screw 30 and tubular body 10 are constructed so that threaded shaft 40 is inserted into body 10. Securing snap shoulder 38 passes through central hole 24 in base wall 20. Since the diameter of snap shoulder 38 is larger than that of central hole 24, screw 30 becomes irreversibly attached to body 10. In this position, threaded shaft 40 lies in a vertically fixed position inside body 10 and is rotatable by means of control member 32 which abuts the bottom exterior wall 22*a* of lower end 22. Furthermore, raised portion 34 fits within lower end 22 such that the outer perimeter of raised portion 34 is in close contact with the inner wall surface 23 of end 22.

Also inside body 10 is a product support 42 which is threadably engaged to threaded shaft 40. Support 42 moves along the length of body 10 in response to turning of screw 30. Support 42 and body 10 are structured to cooperate in a conventional manner to prevent support 42 from rotating about the axis of threaded shaft 40. The material or product 44 to be dispensed sits on top of support 42.

In use, control member 32 is turned thereby rotating shaft 40 and causing support 42 to move inside the body 10 and raise the uppermost portion of product 44 out of dispensing end 12.

Figure 4:
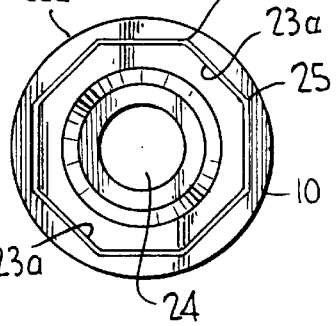
FIG. 4 is a bottom view of a tubular body including an eight sided inner wall surface in the base structure.
Figure 5:
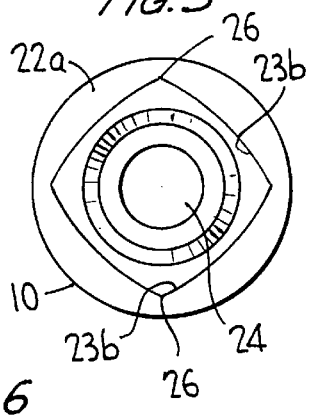
FIG. 5 is a bottom view of a tubular body including a four sided inner wall surface in the base structure.
Figure 6:
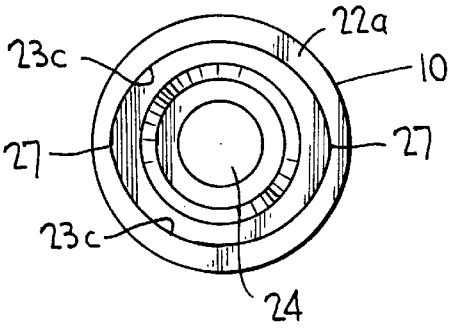
FIG. 6 is a bottom view of a tubular body including an elliptical or two sided inner wall surface in the base structure.

The manner of controlling the amount of product dispensed is more apparent with reference to FIGS. 4, 5 and 6 which show different embodiments of base wall 20 of body 10. Each of FIGS. 4, 5, and 6 illustrate a different shaped inner wall surface 23.

In FIG. 4, base wall 20 has a lower end 22 with an eight sided or octagonal inner wall surface 23*a*. The radius of the octagon formed by the inner wall surface can vary depending on the size of the raised portion 34 which sits adjacent wall surfaces 23*a*. This non-circular structure provided by surfaces 23*a* interacts with protrusions 35 and 36 on raised portion 34 when control member 32 is turned, resulting in varied friction and tension as a function of control member's 32 orientation. The protrusions 35 and 36 fit comfortably in the corners 25 of the octagon, where the radius is greatest, but provide resistance as they are re-oriented over the flat octagonal surfaces to the next octagonal corner. Therefore, control member 32 seeks the orientations in which the protrusions 35 and 36 rest in the larger radius corners and seek to avoid other orientations. The result is a click-action operation, in which the user turns control member 32 and can feel the screw 30 click into position as protrusions 35 and 36 reach the octagonal corners. In the configuration shown in FIG. 4, the applicator will dispense amounts corresponding to ⅛ turn increments, multiples of which the user can easily select by turning past successive favored stopping points. The resistence provided between turns, however, deters accidental turning of control member 32, such as when held in a user's pocket, purse, knapsack or other carrying conveyance.

Depending on the incremental amount desired to be dispersed, a large number of possible inner wall surface 23 shapes are available with each providing a different turn increment preference. The inner wall surfaces are preferably multi-sided with at least two sides. The raised portion 34 has at least one protrusion. Preferred embodiments included on even number of sides on the inner wall surface. In this preferred embodiment, at least two protrusions are preferably present to provide additional strength and resistance which thus provides pronounced click action which better serves the user.

Referring to FIG. 5, base wall 20 of body 10 is shown having a four sided inner wall surface 23*b*. An applicator according to the invention having this inner wall surface configuration will favor ¼ turns and click into the four corners 26 in use.

Referring to FIG. 6, base wall 20 includes a two sided or elliptical inner wall surface 23*c*. In operation, this structure provides increments of ½ turn based on the preferred "corners" 27 in the ellipse. A further example of a base wall not shown in the drawings is one with an inner wall surface having a sixteen sided profile.

Various embodiments of the present invention are available. Numerous inner wall surface configurations are possible according to the principle of click-action interaction between a base wall and a screw member as described above. The number of protrusions can be varied depending on the shape utilized. Further, the tubular body can be cylindrical or any other desired shape since the exterior shape of the tubular body does not affect the invention.

The invention thus provides a cost efficient controlled dispensing applicator. The structure provides the desired function of controlled incremental dispensing based on a non-complex structure and as not requiring multiple additional parts requiring added assembly steps as in prior known devices. The invention is able to provide the improved dispensing by modification of existing components so that no additional materials are required nor added steps in assembly. The features of the invention can be incorporated at the time of molding and, thus, the structure and assembly remain simple while providing great improvement in use.

As will be apparent to one skilled in the art, various modifications can be made within the scope of the aforesaid description. Such modifications being within the ability of one skilled in the art form a part of the present invention and are embraced by the appended claims.

It is claimed:

1. A screw operated applicator for incremental dispensing comprising:

a tubular body including an open dispensing end and a base wall having at least one hole through the base wall;

a threaded movable support inside said tubular body, said support being in contact with an inner wall of said tubular body so as to prevent rotation of the support in the body;

a rotatable dispensing screw including a control member disposed adjacent said base wall, a raised portion including at least one protrusion, a snap member and a threaded shaft extending through said hole in the base wall into said tubular body and along a substantial length of said tubular body, said threaded shaft being threadably engaged with said support; wherein said base wall includes an inner wall surface of a non-circular configuration which surrounds in use said raised portion of the dispensing screw such that said at least one protrusion interacts with said inner wall surface to provide resistance to turning of said control member and to create at least two favored control member orientations; and wherein said rotatable dispensing screw rotates to cause said support to move up or down in relation to said tubular body based on direction of turning of said control member.

2. The applicator according to claim 1 wherein said tubular body is substantially cylindrical.

3. The applicator according to claim 1 wherein said applicator is made of plastic.

4. The applicator according to claim 1 wherein said inner wall surface of the base wall has a multi-sided configuration with each side being of substantially equal length.

5. The applicator according to claim 4 wherein the multi-sided configuration has an even number of sides.

6. The applicator according to claim 5 wherein at least two protrusions are present on said raised portion of said control member.

* * * * *